US009174229B2

(12) United States Patent
Smith

(10) Patent No.: US 9,174,229 B2
(45) Date of Patent: Nov. 3, 2015

(54) DISPENSER HAVING NON-FRUSTRO-CONICAL FUNNEL WALL

(75) Inventor: Scott Edward Smith, Cincinnati, OH (US)

(73) Assignee: The Procter & Gamble Company, Cincinnati, OH (US)

( * ) Notice: Subject to any disclaimer, the term of this patent is extended or adjusted under 35 U.S.C. 154(b) by 535 days.

(21) Appl. No.: 12/814,248

(22) Filed: Jun. 11, 2010

(65) Prior Publication Data

US 2011/0303766 A1 Dec. 15, 2011

(51) Int. Cl.
*B05B 1/34* (2006.01)

(52) U.S. Cl.
CPC ..... *B05B 1/3442* (2013.01)

(58) Field of Classification Search
CPC ..... B05B 1/3442; B05B 1/3447
USPC ..... 239/463, 469, 475, 486, 487, 488
See application file for complete search history.

(56) References Cited

U.S. PATENT DOCUMENTS 1,155,735 A * 10/1915 Gensecke ..... B05B 1/3447 239/488
1,259,582 A 3/1918 Zwolinski
1,324,579 A 12/1919 Binks
1,367,769 A 2/1921 Coffey
2,098,136 A 11/1937 Dyckerhoff
2,657,836 A * 11/1953 Heinz ..... A47G 19/24 222/477
2,878,065 A * 3/1959 Watkins ..... F23D 11/105 239/404
3,587,974 A * 6/1971 Rosenkranz ..... D02G 1/161 239/423
3,692,245 A 9/1972 Needham et al.
4,260,110 A * 4/1981 Werding ..... B05B 1/3436 239/404
4,487,369 A * 12/1984 Du Rocher ..... F02M 51/065 239/488
4,925,101 A 5/1990 Konlecznski et al.
5,067,655 A 11/1991 Farago et al.
5,234,166 A 8/1993 Foster et al.
5,513,798 A 5/1996 Tavor
5,540,389 A 7/1996 Knickerbocker
RE35,744 E 3/1998 Foster et al.
6,161,782 A 12/2000 Heinbuck et al.
6,418,925 B1 * 7/2002 Genova ..... A61M 15/009 128/200.14
6,811,098 B2 11/2004 Drechsel
7,240,860 B2 * 7/2007 Griend ..... B05B 3/0486 239/381
2005/0001066 A1 1/2005 Miyamoto et al.

(Continued)

FOREIGN PATENT DOCUMENTS

JP 51009311 U 7/1974
JP 2008104929 A 5/2008

(Continued)

OTHER PUBLICATIONS

International Search Report—5 Pages.

(Continued)

*Primary Examiner* — Len Tran
*Assistant Examiner* — Joel Zhou
(74) *Attorney, Agent, or Firm* — Larry L. Huston; Steven W. Miller

(57) ABSTRACT

A helix cup for use in a pressurized dispenser. The helix cup has a convergent funnel wall. The funnel wall is not straight and does not satisfy the mathematical equations for surface area or for subtended volume of the frustrum of a cone. Instead, the funnel wall provides a longer flow path than is achieved with straight sidewalls. The longer flow path provides for a tighter particle size distribution at lower pressures than occurs in the prior art.

19 Claims, 11 Drawing Sheets

(56) References Cited

U.S. PATENT DOCUMENTS

| | | | |
|---|---|---|---|
| 2008/0067165 | A1 | 3/2008 | Kern et al. |
| 2008/0067265 | A1 | 3/2008 | Songbe et al. |
| 2008/0142620 | A1 | 6/2008 | Scheidt et al. |
| 2009/0057447 | A1 | 3/2009 | Lowry et al. |
| 2011/0030328 | A1 | 2/2011 | Xu et al. |

FOREIGN PATENT DOCUMENTS

| | | | |
|---|---|---|---|
| SU | 1176967 | | 9/1985 |
| SU | 1389868 | | 4/1988 |
| WO | WO 2008148419 | A1 | 12/2008 |

OTHER PUBLICATIONS

U.S. Appl. No. 12/814,253, filed Jun. 11, 2010, Smith.

"Lefebvre, Atomization and Sprays," 1989, Hemisphere Publishing Co., p. 116.

"All Office Actions, U.S. Appl. No. 12/814,253".

* cited by examiner

DISPENSER HAVING NON-FRUSTRO-CONICAL FUNNEL WALL

FIELD OF THE INVENTION

The present invention relates to atomizers for use with fluid spray devices and more particularly to atomizers suitable for producing relatively small particle size distributions.

BACKGROUND OF THE INVENTION

Fluid atomizers are well known in the art. Fluid atomizers are used in sprayers to atomize a discrete quantity of liquid being dispensed. The liquid may be stored in bulk form in a reservoir 22. A manual pump or propellant charge may be used to provide motive force for drawing the liquid from the reservoir 22, to the atomizer and spraying through a nozzle. Once the liquid is sprayed through a nozzle is may be dispersed to the atmosphere, directed towards a target surface, etc. Common target surfaces include countertops, fabric, human skin, etc.

However, current atomizers do not always provide a sufficiently small particle size distribution, particularly at relatively low propellant pressures. Relatively low propellant pressures are desirable for safety and conservation of propellant material.

Attempts in the art include U.S. Pat. No. 1,259,582 issued Mar. 19, 1918; U.S. Pat. No. 3,692,245 issued Sep. 19, 1972; U.S. Pat. No. 5,513,798 issued May 7, 1996; US 2005/0001066 published Jan. 6, 2005; US 2008/0067265 published Mar. 20, 2008; SU 1389868 published Apr. 23, 1988; and SU 1176967 published Sep. 7, 1985. Each of these attempts shows a convergent flowpath provided by straight sidewalls.

The straight sidewalls correspond to conventional wisdom that the shorter flow path provided thereby results in less drag. For example see Lefebvre, Atomization and Sprays (copyright 1989), Hemisphere Publishing Company. Page 116 of Lefebvre shows three different nozzle designs. All three nozzles shave straight sidewalls. Lefebvre specifically teachers improving the quality of atomization by including the "minimum area of wetted surface to reduce frictional losses." Id.

Lefebvre furthers recognizes the problem of trying to achieve desirable flow characteristics at relatively low flow rates, and the efforts to achieve flow at less than 7 MPa. Lefebvre further acknowledges that a major drawback of the simplex atomizer is that flow rate varies with only the square root of pressure differential. Thus doubling flow rate requires a four times increase in pressure. Id at pp. 116-117.

Another problem with atomizers found in the prior art is that to increase or decrease the cone angle of the spray pattern using an atomizer having the straight sidewalls of the prior art requires rebalancing various flow areas, (e.g. swirl chamber diameter, tangential flow area, exit orifice diameter or length/diameter ratio). Using the present invention, one of ordinary skill knowing the desired product delivery characteristics can easily rescale the helix cup to provide new spray characteristics and simply change out the helix cup to a new one. This process improves manufacturing flexibility and reduces cost relative to changing the entire cap, as occurs in the prior art.

It can be seen there is a need for a different approach, and one which allows for desirable spray characteristics at relatively low pressures.

SUMMARY OF THE INVENTION

The invention comprises a helix cup for use with a pressurized dispenser. The helix cup has a funnel wall which is not frustro-conical. This geometry provides a flow area defined as a convergent surface of revolution having a curvilinear funnel wall.

DETAILED DESCRIPTION OF THE INVENTION

Figure 1:
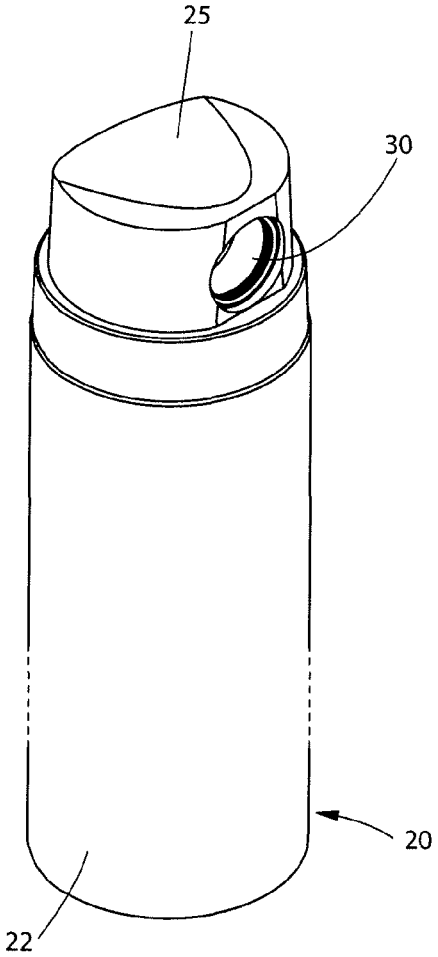
FIG. 1 is a perspective view of an illustrative aerosol container usable with the present invention.

Referring to FIG. 1, the invention is usable with a permanently sealed pressurized container, such as an aerosol dispenser 20. Typically an aerosol dispenser 20 may comprise a reservoir 22 used to hold liquid product and a push button 25 valve system on or juxtaposed with the top. The dispenser 20 may have a cap 24, which optionally and interchangeably houses the other components described hereinbelow. The user manually depresses the push button 25, releasing product under pressure from the reservoir 22 to be sprayed through a nozzle 32. Illustrative, and non-limiting products usable with the present include hair sprays, body sprays, air fresheners, fabric refreshers, hard surface cleaners, disinfectants, etc.

The reservoir 22 of the aerosol dispenser 20 may be used for holding fluid product, propellant and/or combination thereof. The fluid product may comprise a gas, liquid, and/or suspension. The aerosol dispenser 20 may also have a dip tube, bag on valve or other valve arrangement to selectively control dispensing, as desired by the user and as are well known in the art.

The reservoir 22, cap 24 and/or other materials used for manufacture of the dispenser 20 may comprise plastic, steel aluminum or other materials known to be suitable for such applications. Additionally or alternatively, the materials may be bio-renewable, green friendly and comprise bamboo, starch-based polymers, bio-derived polyvinyl alcohol, bio-derived polymers, bio-derived fibers, non-virgin oil derived fibers, bio-derived polyolefinics, etc.

Figure 2A:
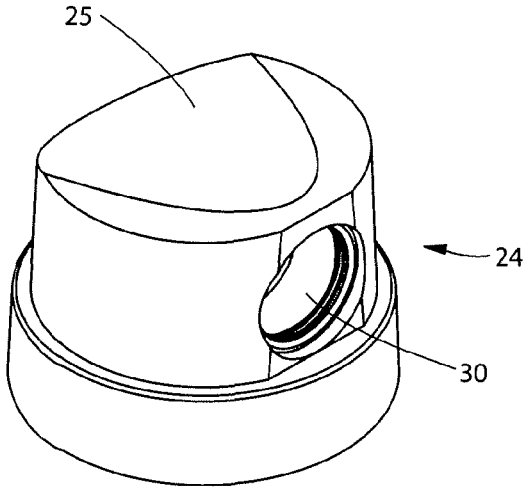
FIG. 2A is a perspective view of the illustrative spray of FIG. 1.
Figure 2B:
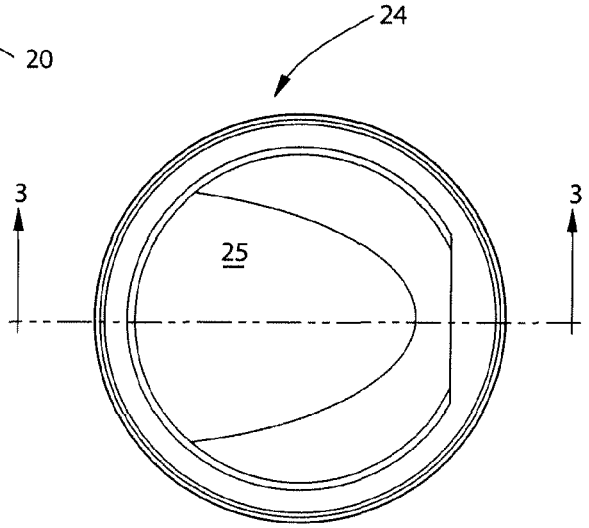
FIG. 2B is a top plan view of the spray cap of FIG. 2A.

Referring to FIGS. 2A and 2B, the cap 24 further comprises a nozzle 32, through which the product to be dispensed is atomized into small particles. The nozzle 32 may be round, as shown, or have other cross sections, as are known in the art. The nozzle 32 may be externally chamfered, as is known in the art, to increase the cone angle of the spray. A chamfer of 20 to 30 degrees has been found suitable. The particles may be dispensed into the atmosphere or onto a target surface.

Figure 3:
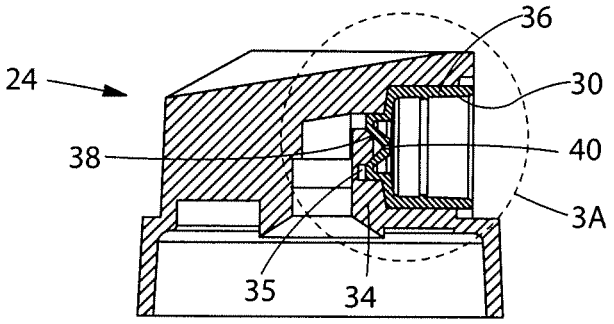
FIG. 3 is a vertical sectional view of the spray cap of FIG. 2A, taken along line 3-3 of FIG. 2B.
Figure 3A:
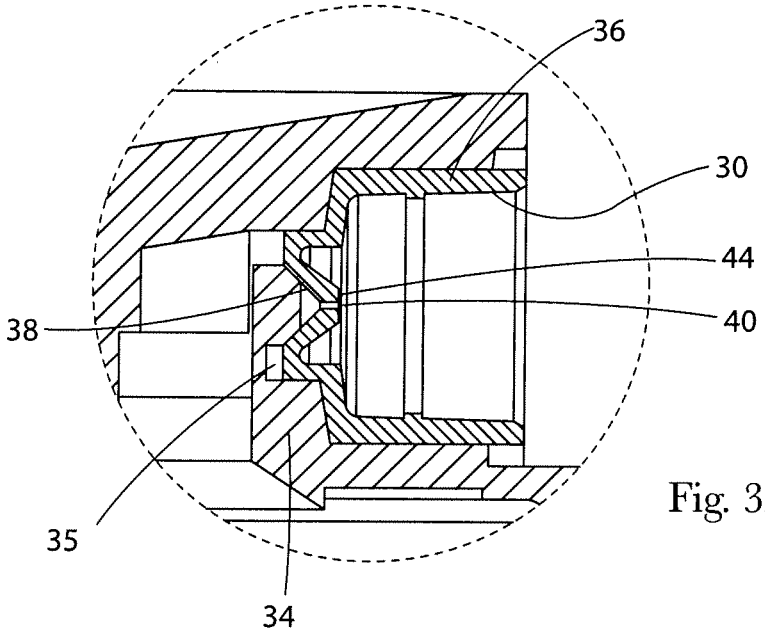
FIG. 3A is an enlarged partial view of the indicated area of FIG. 3, showing the helix cup and backstop within the housing.
Figure 3B:
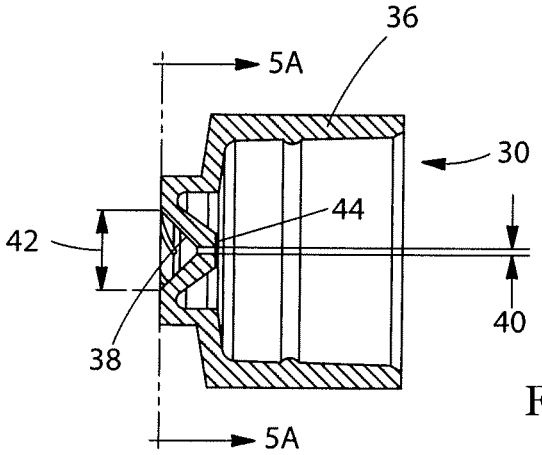
FIG. 3B is enlarged view of the helix cup of FIG. 3.

Referring to FIGS. 3, 3A and 3B, the invention comprises a helix cup 30. The helix cup 30 may be a discrete component insertable into a cap 24 of a spray system, as shown. Alternatively, the helix cup 30 may be integrally molded into the cap 24. The helix cup 30 may be injection molded from an acetal copolymer.

The helix cup 30 may be inserted into the cap 24, and particularly into the housing 36 thereof. The housing 36 may have a backstop 34. The backstop 34 limits insertion of the helix cup 30 into the housing 36 of the cap 24. The backstop 34 further forms a cutting plane 84 with the helix cup 30.

Upon depressing the button 25 to initiate dispensing, product, and optionally propellant mixed therewith, is released from the reservoir 22 and flows through a valve, as is well known in the art. The product enters a chamber 35 in the backstop 34 which chamber 35 is upstream of the cutting plane 84. The chamber 35 fills with the product to be dispensed. The chamber 35 may be annular in shape and circumscribe the axis of the nozzle 32.

Figure 4A:
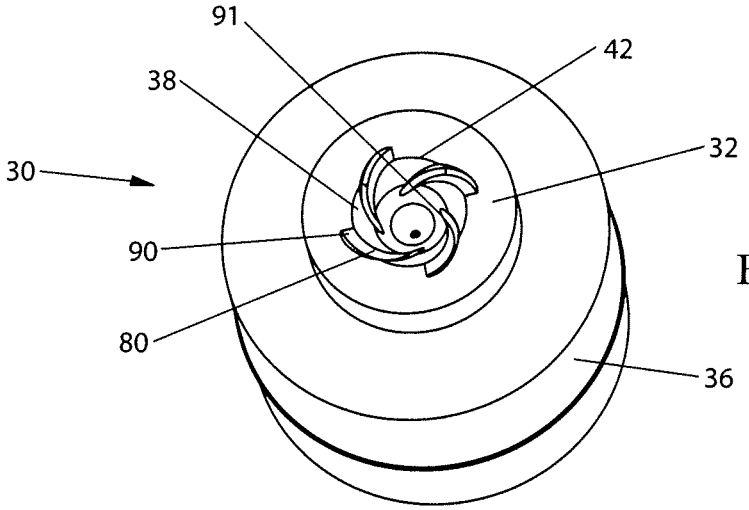
FIG. 4A is perspective view of an illustrative helix cup showing the inlet and having four channels.
Figure 4B:
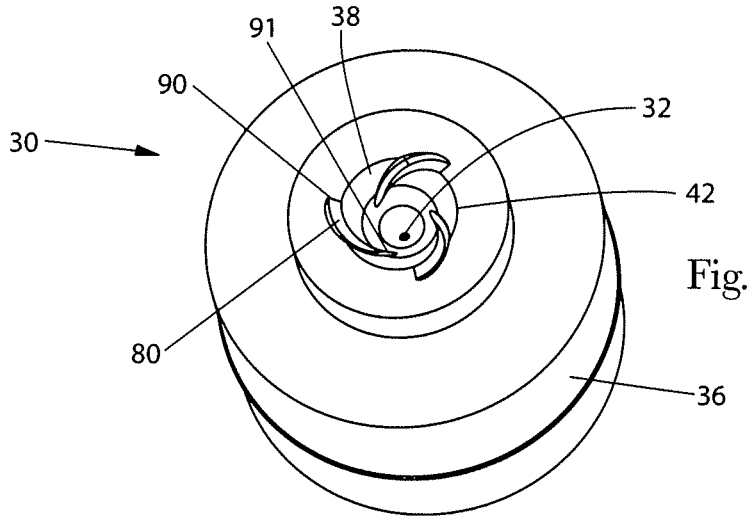
FIG. 4B is perspective view of an illustrative helix cup showing the inlet and having three channels.
Figure 4C:
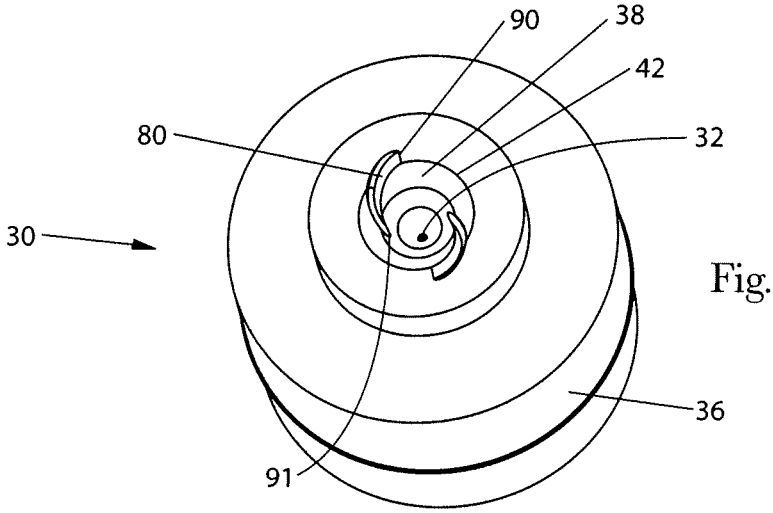
FIG. 4C is perspective view of an illustrative helix cup showing the inlet and having two channels.

Referring to FIGS. 4A, 4B, 4C, the helix cup 30 may comprise a cylindrical housing 36. The housing 36 may have a longitudinal axis L-L therethrough. The helix cup 30 may have two longitudinally opposed ends, a first end with a funnel wall 38 and a generally open second end.

Figure 5:
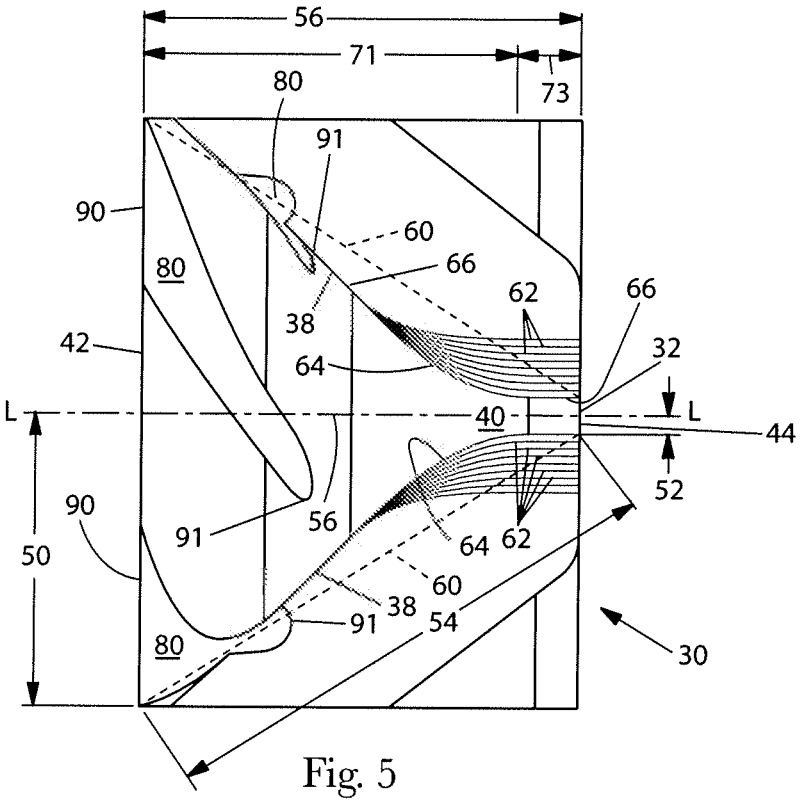
FIG. 5 is a enlarged, fragmentary sectional view of the helix cup of FIG. 3B.
Figure 5A:
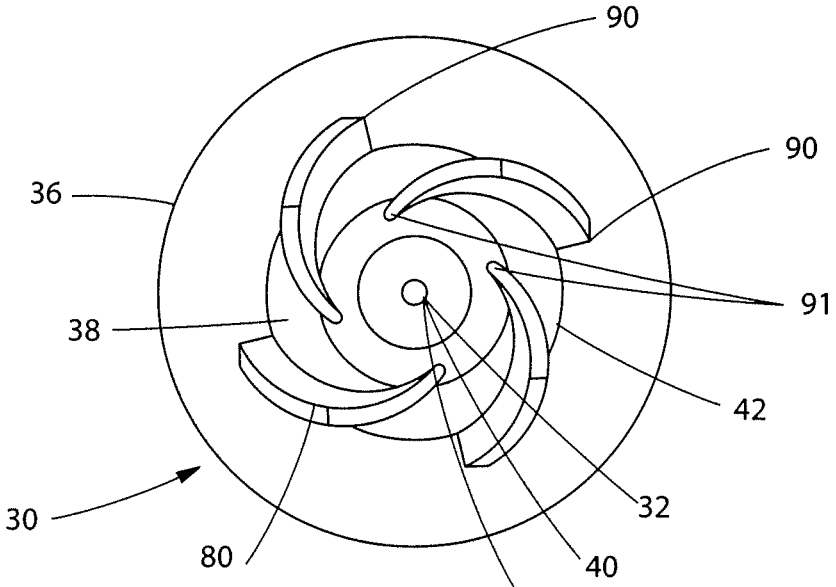
FIG. 5A is a profile of the helix cup of FIG. 5, showing the inlet and taken in the direction of lines 5A-5A in FIG. 3B.

Referring to FIGS. 5 and 5A, the funnel wall 38 forms the basis of the present invention, while the other components of the helix cup 30 are ancillary. An orifice may be disposed to provide a flow path through the funnel wall 38, and having an inlet and outlet 44. The outlet 44 may be the nozzle 32. The orifice may be centered in the helix cup 30, or may be eccentrically disposed. The orifice may be generally longitudinally oriented, and in a degenerate case parallel to the longitudinal axis L-L. The orifice may be of constant diameter or may taper in the axial direction. For the embodiments described herein, a constant orifice diameter of 0.13 mm to 0.18 mm may be suitable.

The funnel wall 38 has an inlet radius 50 at the first end and an outlet 44 radius corresponding to the nozzle 32 exit. The axial distance 56 between the inlet radius 50 and outlet 44 is parallel to the longitudinal axis L-L, and cone length 54 is the distance along the sidewall taken in the axial direction.

Figure 15A:
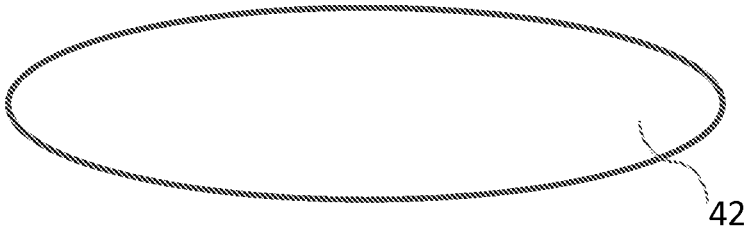
FIGS. 15A and 15B show frontal views of nonround inlets and outlets, it being understood that either figure could show an inlet or outlet.
Figure 15B:
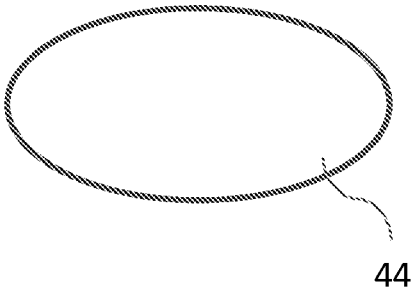

The inlet 42 and outlet 44 may be round as shown. Referring to FIGS. 15A, 15B, alternatively, the inlet 42 and/or outlet 44 may be nonround. Referring back to FIGS. 5 and 5A, the prior art teaches a flow path having a frustrum of a right circular cone. The flow path provides a surface area given by:

The prior art teaches a flow path having a frustrum of a right circular cone. This flow path provides a surface area given by:

$$\text{Area}=\Pi\times\text{cone length}\times(\text{inlet radius}+\text{outlet radius}), \quad (1)$$

wherein the inlet radius 50 is greater than the outlet 44 radius, cone length 54 is the distance between the inlet and outlet 44 taken along the sidewall skewed relative to the longitudinal axis L-L, and Π is the known constant of approximately 3.14.

For the helix cup 30 of the present invention, the area of the flow path may be at least 10%, 20%, 30%, 40%, 50%, 75% or 100% greater than the area of a comparable frustrum of a right circular cone having the same inlet radius 50, outlet radius 52 and cone length 54.

The subtended volume is given by:

$$\Pi/3\times h\times[\text{inlet radius}\hat{}2+\text{outlet radius}\hat{}2+(\text{inlet radius}\times\text{outlet radius})], \quad (2)$$

wherein h is the axial distance 56 between the inlet and outlet 44 taken parallel to the longitudinal axis L-L.

The frustrum flow path provides a convergent straight sidewall 60 shown in phantom, which would be predicted by one of ordinary skill to provide the least drag and flow resistance of all possible shapes. For example, in the aforementioned book Sprays and Atomization by Lefebvre, page 116, it is specifically taught that straight, convergent sidewalls are known and used in the art.

For the helix cup 30 of the present invention, the subtended volume of the flow path may be at least 10%, 20%, 30%, 40%, 50%, 75% or 100% greater than the subtended volume of a comparable frustrum of a right circular cone having the same inlet radius 50, outlet radius 52 and cone length 54. Likewise the helix cup 30 of the present invention, may have a subtended volume at least 10%, 20%, 30%, 40% or 50%, less than the subtended volume of a comparable frustrum of a cone.

Referring particularly to FIG. 5, it has been surprisingly found that improved results are achieved by having a longer flow path than is achievable with straight sidewalls. The longer flow path may be provided by having a funnel wall 38 which is concave, as shown. FIG. 5 further shows different hypothetical nozzle 32 diameters 62 usable with the funnel wall 38 of the present invention. The surface area of the funnel wall 38 will increase with greater nozzle 32 diameters 62, as illustrated.

Of course, the entire funnel wall 38 need not be arcuately shaped. As shown, the portion 64 of the funnel wall 38 juxtaposed with the orifice may be arcuate and the balance 66 of the funnel wall 38 may be straight. As used herein, straight refers to a line taken in the axial direction along the funnel wall 38 and may be thought of as the hypotenuse of a triangle disposed on the funnel wall 38, having one leg coincident the longitudinal axis L-L and having the other leg be a radius of the circle connected to the hypotenuse.

The funnel wall 38 of FIG. 5 may be conceptually divided into two portions, a first convergent portion 71 having variable flow area and a second straight portion 73 having constant flow area. The ratio of the axial length of the first area 71 to the second area 73 may be determined. For the embodiments described herein, the ratio of axial lengths of the first portion 71 to the second portion 73 may range from 1:3 to 3:1, from 1:2 to 2:1 or be approximately equal, providing a ratio of approximately 1:1. Furthermore, the ratio of the inlet area to the nozzle 32 area may be at least 1:1, 5:1, 7:1, 10:1 or 15:1.

Referring back to FIGS. 4A, 4B, 4C the funnel wall 38 may have one or more grooves 80 therein, as shown. Alternatively, the funnel wall 38 may have one or more fins thereon. The grooves 80 or fins act to influence the flow direction. This influence imparts a circumferential directional component to the flow as it discharges through the orifice. The circumferential flow direction is superimposed with the longitudinally axial flow direction to provide a convergent helical, spiral flow path.

The grooves 80 may be equally or unequally circumferentially spaced about the longitudinal axis L-L, may be of equal or unequal depth, equal or unequal length in the helical direction, equal or unequal width/taper, etc. FIGS. 4A, 4B, 4C show four, three and two axisymmetric grooves 80, respectively, although the invention is not so limited and may comprise more or fewer grooves 80 in symmetric and asymmetric dispositions, sizes, geometries, etc. The grooves 80 have a variable circumferential component, tapering towards the longitudinal axis L-L as the nozzle 32 is approached. To approach the nozzle 32, one of skill will recognize the grooves 80 also have an axial component.

Figure 6:
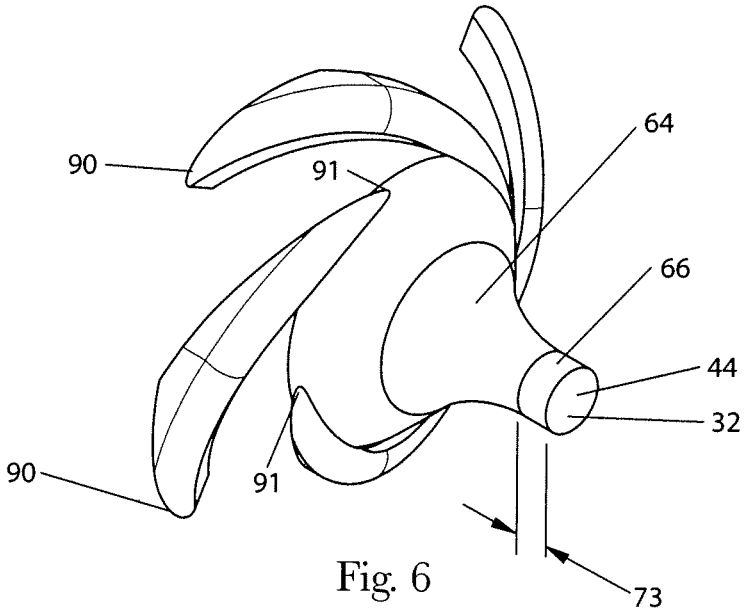
FIG. 6 is a perspective view of the flow path from the annular chamber to the nozzle outlet of the helix cup of FIG. 4A.
Figure 7:
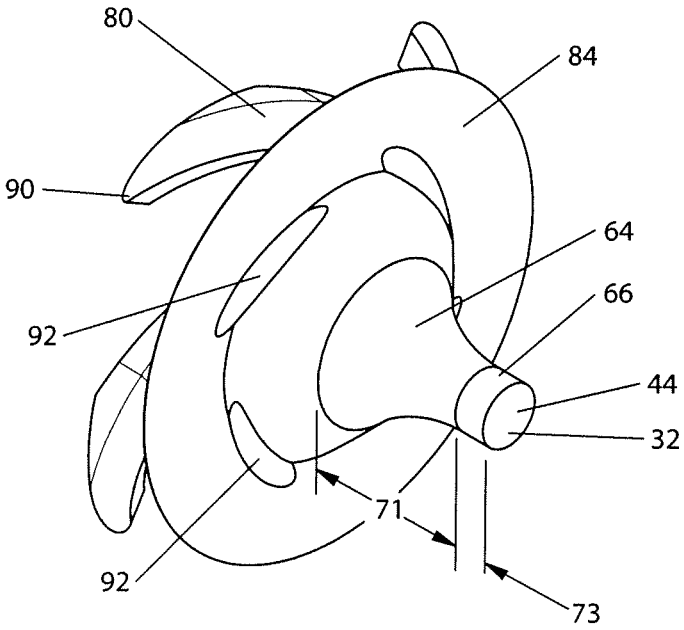
FIG. 7 is a perspective view of the flow path from the annular chamber to the nozzle outlet of the helix cup of FIG. 4A, showing the cutting plane formed by the backstop.

Referring to FIGS. 6-7, the fluid flow path is shown for the embodiment of FIG. 4A having four equally spaced and equally sized grooves 80. The flow enters the annular chamber 35 of the backstop 34, flows into each of the four grooves 80, passes the cutting plane 84 and enters the helix cup 30. The cutting plane 84 is a virtual plane which conceptually divides the flow between the grooves 80 and the convergent portion of the flow path 71.

Referring to FIG. 7, each groove 80 has a first end 90, which is the upstream end of the groove 80. The upstream end of the groove 80 may be the portion of the groove 80 having the greatest radius with respect to the longitudinal axis L-L. Flow may enter the groove 80 at the first, upstream end. The groove 80, and any product/propellant flow therein, spirals inwardly from the first end 90, towards the longitudinal axis L-L. The groove 80 terminates at a second end 91. The second end 91 may be the portion of the groove 80 having the smallest radius with respect to the longitudinal axis L-L.

The flow area of the present invention may be conceptually divided into two flow paths. The first flow path is divided between four discrete grooves 80, and does not circumscribe the longitudinal axis L-L at any particular cross section. The second flow path, contiguous with the first, blends the flow to circumscribe the longitudinal axis L-L at all cross sections from the virtual plane to the nozzle 32. Contrary to the prior art, the projected length of the first flow path, may be less than the projected length of the second flow path, taken parallel to the longitudinal axis L-L.

Figure 8:
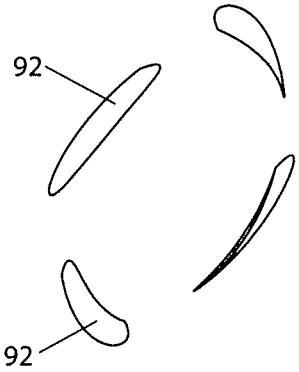
FIG. 8 is a perspective view of the ports of the flow path from the annular chamber into the helix cup of FIG. 4A.

Referring to FIG. 8, the interface between the four grooves 80 within the housing 36 and the helix cup 30 provides four ports, one corresponding to each groove 80. The ports are the planar projection of the flow area between the second end 91 of the groove 80 and the helix cup 30. Upstream of the ports, the flow is divided into discrete flow paths corresponding to the grooves 80. Downstream of the ports, the four discrete flow paths can intermix and converge in the circumferential direction to form a continuous film and be discharged through the nozzle 32.

The flow in the continuous film of the helix cup 30 circumscribes the longitudinal axis. Further the flow converges in the axial direction, as the nozzle 32 is approached. The flow in the helix cup 30 radially converges in the axial direction. Such radial convergence may be about a concave wall 64, a convex wall or a combination thereof.

The converging wall may have some portions 66 which are straight, but the entirety of the wall, from the one or more inlet port(s) to the nozzle 32 is not. By straight, it is meant that a line on the wall from an inlet port 92 to the nozzle 32, forms the hypotenuse of a triangle. As noted above, the triangle has one leg coincident the longitudinal axis and the other leg a radius of the circle connected to the hypotenuse.

In the helix cup 30, flow can intermix and circumscribe the longitudinal axis. As the flow approaches the discharge nozzle 32, the flow may converge. Such convergence increases the density of the flow, creating a low pressure zone. Further, the radius of the flow decreases throughout much of the longitudinal direction, although a portion of constant radius may be included proximate the discharge nozzle 32.

Figure 9A:
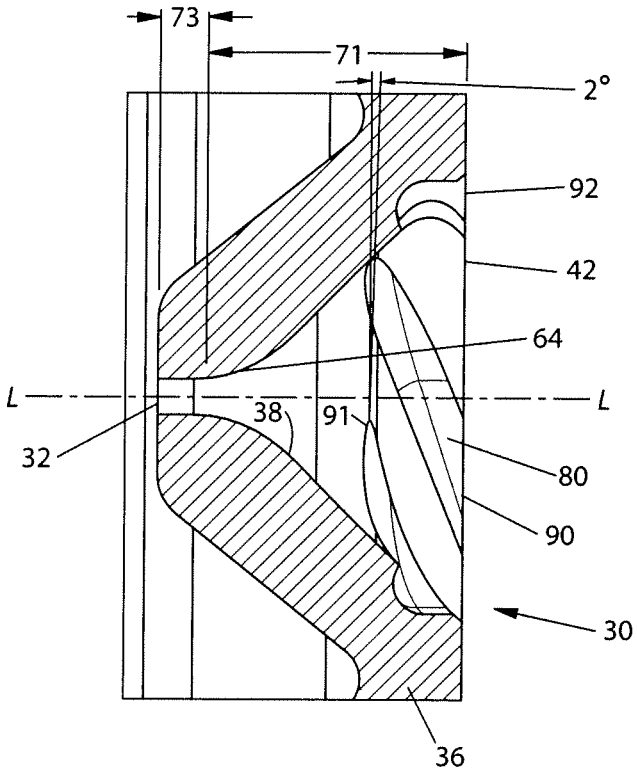
FIG. 9A is a vertical sectional view of an illustrative helix cup having grooves with an approximately 2 degree skew angle.
Figure 9B:
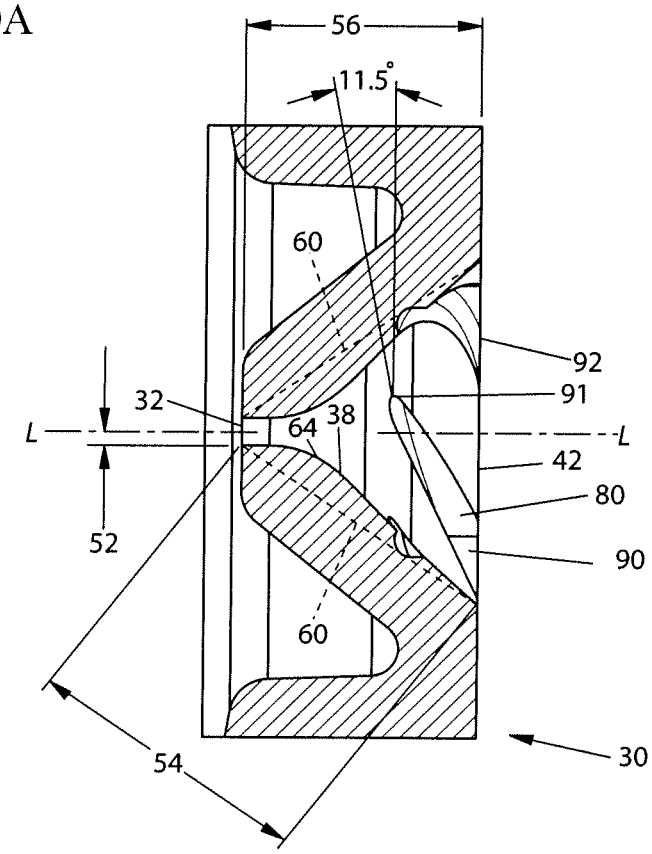
FIG. 9B is a vertical sectional view of an illustrative helix cup having grooves with an approximately 11.5 degree skew angle.

Referring to FIGS. 9A and 9B, the grooves 80 may be skewed relative to a virtual plane disposed perpendicular to the longitudinal axis. The skew may be constant or may increase as the nozzle 32 is approached. For the embodiments described herein, a skew angle relative to the cutting plane 84 of about 2° to about 11.5° has been found suitable. If the skew angle changes throughout the length of the groove 80, the skew may increase as the second end 91 of the groove 80 is approached, terminating within the aforementioned skew angle range. The skew angle may be determined between the smallest angle of the vector through the centroid of the groove 80 at the position of the cutting plane 84 and the cutting plane 84. A tighter particle size distribution has been found to occur with an 11.5° skew angle than with a 2° skew angle.

Figure 10:
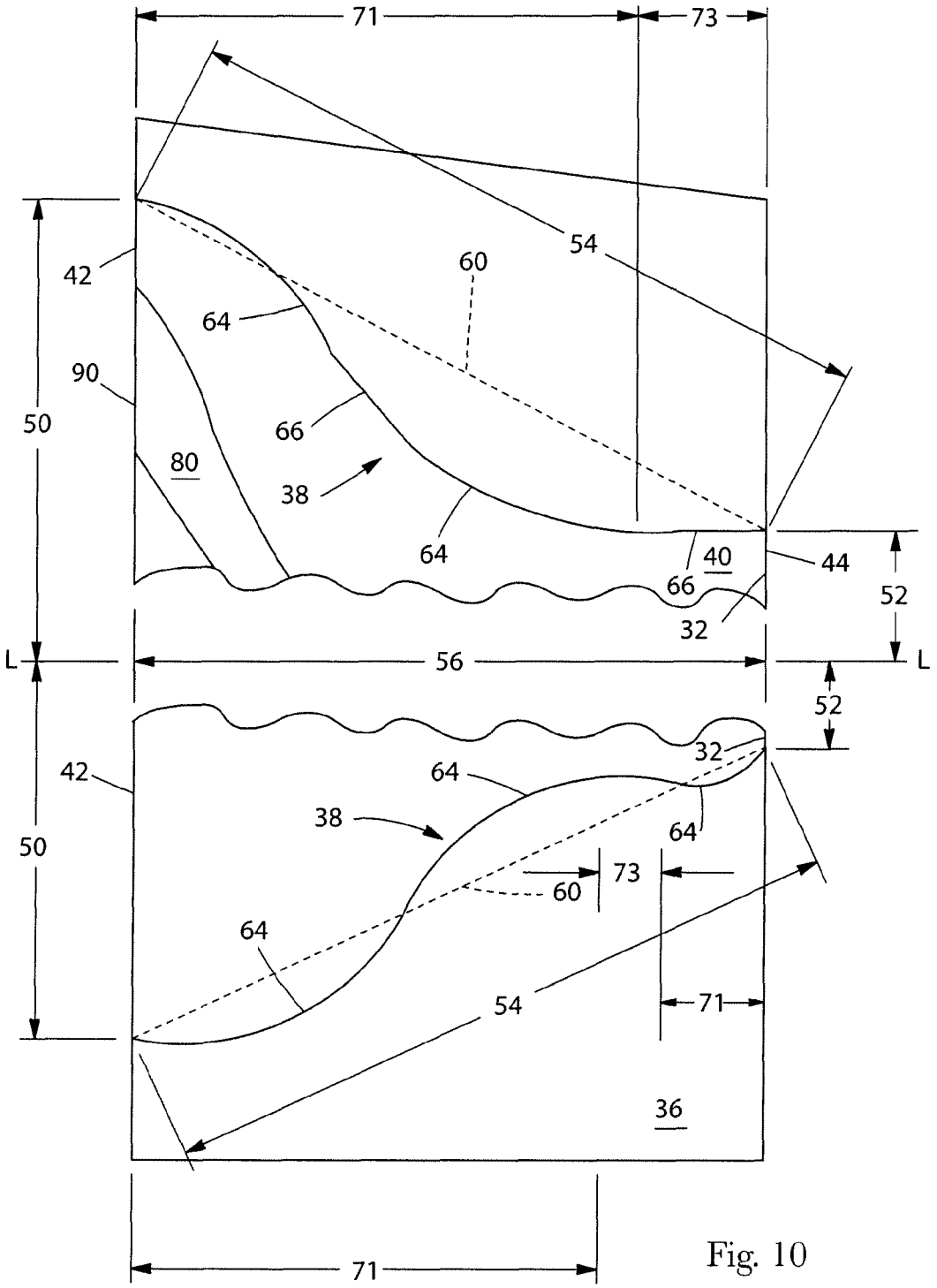
FIG. 10 is a broken vertical sectional view of alternative embodiments of a helix cup, the upper embodiment having a single groove, and a funnel wall with convex, concave and constant cross section portions, the lower embodiment having no groove and a funnel wall with two convex portions having a concave portion therebetween.

Referring to FIG. 10 in another embodiment, the funnel wall 38 may be partially or completely convexly shaped. In this embodiment, like the previous embodiments, the funnel wall 38 deviates from linearity between the funnel wall 38 inlet 42 and the funnel wall 38 outlet 44 at the nozzle 32. This geometry, like the previous geometries, may have a surface area and subtended volume which do not correspond to the equalities set forth in equations (1) and (2) above.

One of skill will recognize that hybrid geometries are also feasible and within the scope of the claimed invention. In a hybrid embodiment, a portion of the funnel wall 38 may be convex, another portion may be concave, and optionally, yet another portion may be linear. Again, in such a geometry, the funnel wall 38 may have a surface area and subtended volume which do not correspond to the equalities set forth in equations (1) and (2) above.

The embodiments of FIG. 10 show a funnel wall 38 having contiguous concave and convex portions 64 in the convergent portion 71 of that funnel wall 38. The lower embodiment of FIG. 10 further has a concave portion 64 which is not convergent at 73. By concave it is meant that the cross section of the funnel wall 38 taken parallel to the longitudinal axis L-L is outwardly arcuate relative to the hypotenuse 60 joining the edge of the inlet 42 and outlet 44. By convex it is meant that the cross section of the funnel wall 38 taken parallel to the longitudinal axis L-L is inwardly arcuate relative to the hypotenuse 60 joining the edge of the inlet 42 and outlet 44.

More particularly, in the upper portion of FIG. 10, moving longitudinally from the inlet 42 towards the outlet 44, the convergent portion 71 of the funnel wall 38 has a convex portion 64, a straight portion 66 and a concave portion 64. The funnel wall also has a portion 73 of constant cross section and which has straight sidewalls 66.

In the lower portion of FIG. 10, substantially the entire funnel wall 38 is convergent as indicated at portions 71. Moving longitudinally from the inlet 42 towards the outlet 44, the first convergent portion 71 comprises both a convex wall 64 and contiguous concave wall 64. The concave funnel wall 38 inflects to not be convergent as indicated at 73. The funnel wall 38 converges at slightly convex portion 64, to terminate at the nozzle 32 without having a straight portion in the funnel wall. 38.

Figure 11A:
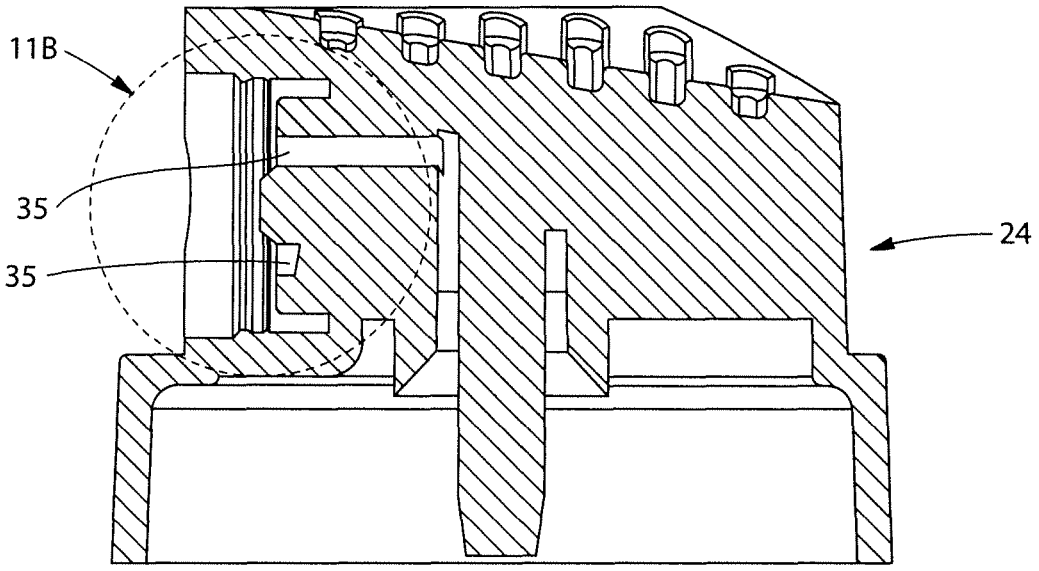
FIG. 11A is a vertical sectional view of an alternative embodiment of a cap having a more rigid backstop and the helix cup omitted for clarity.
Figure 11B:
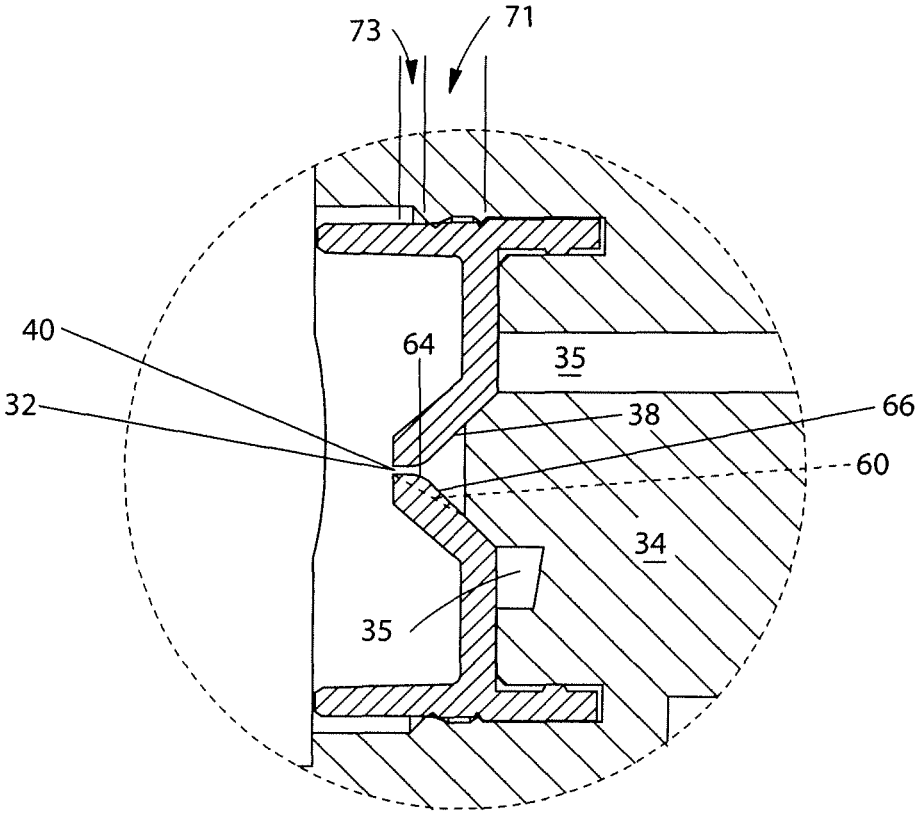
FIG. 11B is an enlarged partial view of the indicated area of FIG. 11A, showing the backstop with a helix cup inserted in the housing.

Referring to FIGS. 11A-11B, the backstop 34 must be rigid enough to withstand the back pressure encountered during forward spray of the fluid from the dispenser 20. The backstop 34 must also be able to prevent deflection during assembly of the helix cup 30 to the cap 24. If the backstop 34 deflects during assembly, the helix cup 30 may be inserted too deeply into the cap 24, and proper dispensing may not occur. To prevent this occurrence, a thicker and/or more rigid backstop 34 may be utilized.

Referring particularly to FIG. 11B, the backstop 34 may be conically or otherwise convexly shaped. This geometry allows the helix cup 30 to accurately seat during manufacture. Other shapes are suitable as well, so long as a complementary seating surface is presented between the backstop 34 and helix cup 30.

In another embodiment, the helix cup 30 may be used with a trigger pump sprayer or a push button 25 finger sprayer, as are known in the art. In pump sprayers, the differential pressure is created by the hydraulic pressure resulting from piston displacement in response to the pumping action.

Once the piston is charged with product, it is ultimately disposed into the helix cup 30 under pressure, using any suitable flow path, as is known in the art. Upon dispensing from the helix cup 30, the aforementioned benefits may be achieved.

The present invention may be used with aerosol dispensers 20 having a gage pressure less than about 1.9, 1.5, 1.1, 1.0, 0.9, 0.7, 0.5, 0.4 or 0.2 MPa. The present invention unexpectedly provides for improved particle size distribution without undue increase in the gage pressure.

As in the case of the aerosol dispenser 20, relatively lower pressures may be used than with prior art trigger sprayers or push button 25 sprayers, while benefitting from a relatively tighter particle size distribution. The relatively lower pressure provides the benefit that tighter seals are not necessary for the pump piston and less manual force to actuate the pump using the finger or hand is required. The benefit to not requiring relatively tighter seals is that manufacturing tolerances become easier to achieve. As the force to actuate the pump dispenser decreases, the user encounters less fatigue from manual actuation. As fatigue decreases, the user is more likely to manually dispense an efficacious amount of the product from the trigger sprayer or push button 25 sprayer. Furthermore, as gage pressure decreases, the wall thickness of the reservoir 22 may proportionately decrease. Such decrease in wall thickness conserves material usage and improves disposability.

EXAMPLES

Three different spray systems were tested. The first sample 100 utilized the helix cup 30 of FIGS. 3-3B and 5-8. This helix cup 30 had four grooves 80, an approximately 64 degree included angle, and an outlet 40 having a diameter of 0.18 mm. The ratio of the flow area of the grooves 80 to the flow area of the nozzle 32 is approximately 7.5:1.

The second sample 200 is a commercially available Kosmos spray actuator sold by Precision Valve Co. having an orifice diameter of 0.18 mm.

The third sample 300 is a helix cup 30 having the same groove 80 geometry, outlet 40 diameter of 0.18 mm, same flow area ratio of approximately 7.5:1, and the same included angle of approximately 64 degrees. But the third sample had the frustro-conical funnel wall 38, discussed by Lefebvre. The funnel wall 38 of sample 300 was approximately 20 percent greater than the corresponding area of the funnel wall 38 of sample 100.

Each sample 100, 200, 300 was loaded with 50 ml of deodorant spray product and charged with propellant to approximately 850 KPa. Each sample was then sprayed, and various measurements were made.

Figure 12:
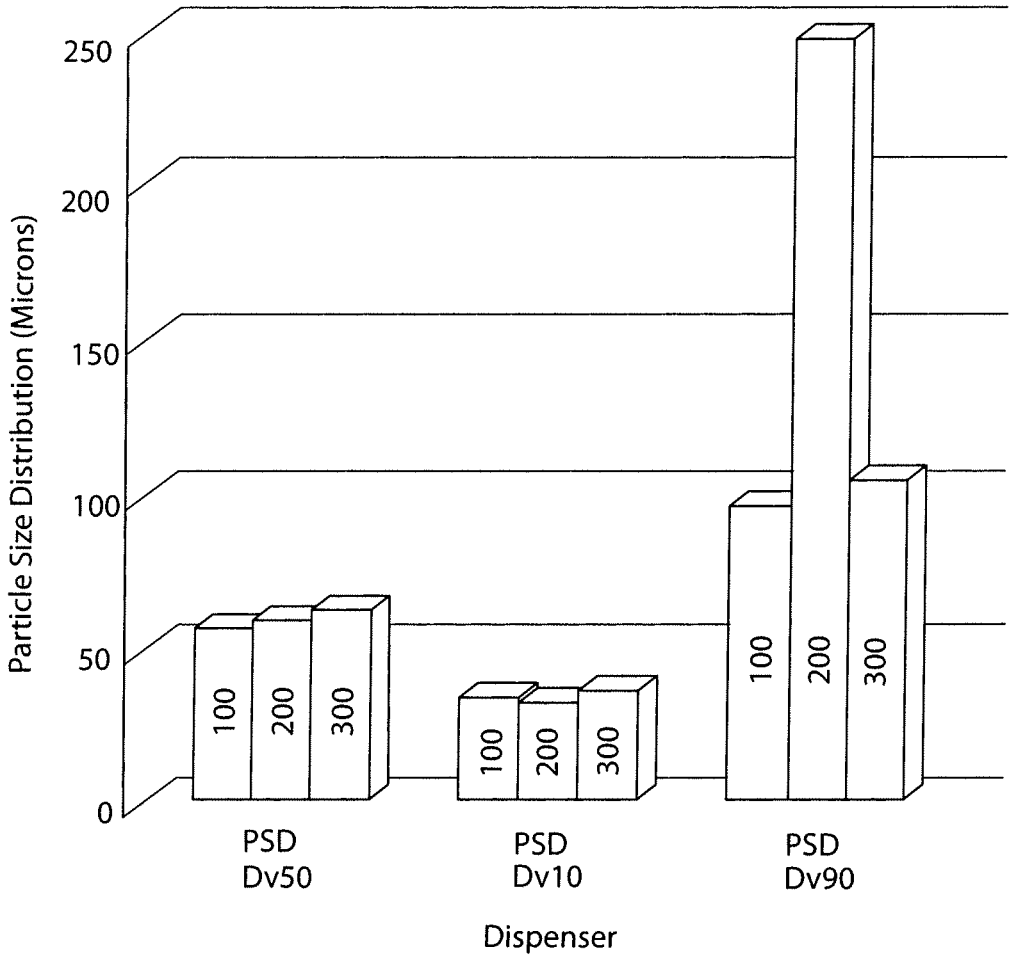
FIG. 12 is a graphical representation of three particle size distribution measurements, as measured on three different spray systems.

Referring to FIG. 12, the Dv(10), Dv(50) and Dv(90) particle size distribution measurements were made, using laser diffraction analysis techniques well known in the art. FIG. 12 shows little variation between samples 100, 200, 300 for the Dv(10) and Dv(50) particle size distribution measurements. However, the Dv(90) particle size distribution measurements showed the commercially available Kosmos actuator 200 provided a particle size distribution at least double that of the samples 100, 300 using helix cups 30. Furthermore, the helix cup 30 sample 100 of FIGS. 3-3B and 5-8 advantageously yielded a slightly smaller Dv(90) particle size distribution than the frustro-conical helix cup 300.

Figure 13:
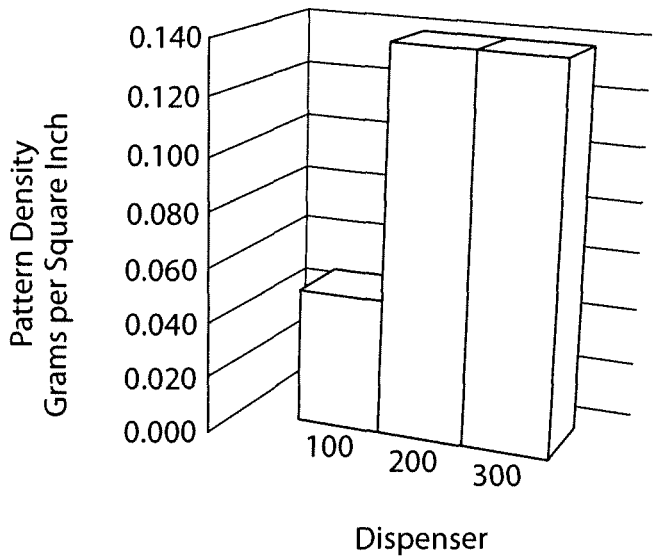
FIG. 13 is a graphical representation of a pattern density measurement, as measured on three different spray systems.

Referring to FIG. 13, one might expect the pattern distribution data to follow the particle size distribution data. But unexpectedly, the helix cup 30 sample 100 of FIGS. 3-3B and 5-8 advantageously yielded a considerably smaller pattern diameter than either of the other two samples, 200, 300. The difference in Dv(90) particle size distribution is significant, with sample 100 having a Dv(90) particle size distribution less than half that of the other two samples 200, 300.

Figure 14:
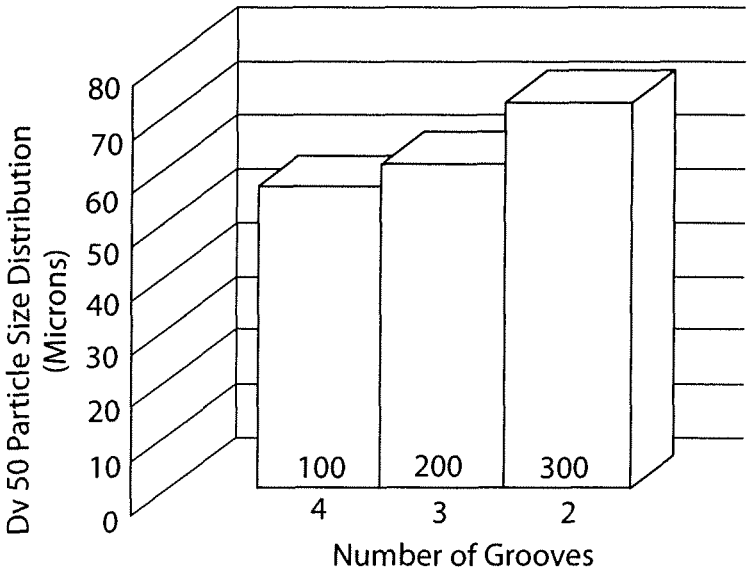
FIG. 14 is a graphical representation of the effect of the number of grooves on particle size distribution as measured on a spray system.

Referring to FIG. 14, the helix cups 30 of FIGS. 4A, 4B and 4C and having the funnel wall 38 geometry shown in FIGS. 3-3B and 5-8 was tested. However, the number of grooves 80 was varied, as illustrated in FIGS. 4A, 4B and 4C. The individual groove 80 geometry remained unchanged, just the number of grooves 80 was varied. FIG. 14 shows that Dv(50) particle size distribution varies inversely with the number of grooves.

All percentages stated herein are by weight unless otherwise specified. It should be understood that every maximum numerical limitation given throughout this specification will include every lower numerical limitation, as if such lower numerical limitations were expressly written herein. Every minimum numerical limitation given throughout this specification will include every higher numerical limitation, as if such higher numerical limitations were expressly written herein. Every numerical range given throughout this specification will include every narrower numerical range that falls within such broader numerical range, as if such narrower numerical ranges were all expressly written herein.

The dimensions and values disclosed herein are not to be understood as being strictly limited to the exact numerical values recited. Instead, unless otherwise specified, each such dimension is intended to mean both the recited value and a functionally equivalent range surrounding that value. For example, a dimension disclosed as "40 mm" is intended to mean "about 40 mm."

Every document cited herein, including any cross referenced or related patent or application, is hereby incorporated herein by reference in its entirety unless expressly excluded or otherwise limited. The citation of any document is not an admission that it is prior art with respect to any invention disclosed or claimed herein or that it alone, or in any combination with any other reference or references, teaches, suggests or discloses any such invention. Further, to the extent that any meaning or definition of a term in this document conflicts with any meaning or definition of the same term in a document incorporated by reference, the meaning or definition assigned to that term in this document shall govern.

While particular embodiments of the present invention have been illustrated and described, it would be obvious to those skilled in the art that various other changes and modifications can be made without departing from the spirit and scope of the invention. It is therefore intended to cover in the appended claims all such changes and modifications that are within the scope of this invention.

What is claimed is:

1. A helix cup for use with a pressurized dispenser, said helix cup comprising: an inlet and an outlet defining a straight longitudinal axis and a convergent flow area therebetween, a funnel wall extending from said inlet to said outlet, said inlet having an inlet area, and said outlet having an outlet area, said inlet area being greater than said outlet area, and at least one portion being concave or convex in the longitudinal direction between said inlet and said outlet, said funnel wall having a surface area, said surface area being defined by the inequality: area:≠π×cone length×(inlet radius+outlet radius), wherein the inlet radius is greater than the outlet radius, cone length is the distance between the inlet and outlet taken along the funnel wall and is skewed relative to the longitudinal axis, Fl is the known constant of approximately 3.14, and further comprising at least one flow diverter disposed on said funnel wall, said flow diverter imparting a spiral flow component to fluid flowing from said inlet to said outlet, said flow diverter comprising at least one groove in said funnel wall.

2. A helix cup for use with a pressurized dispenser, said helix cup comprising: an inlet and an outlet defining a straight longitudinal axis and a convergent flow area therebetween, a funnel wall extending from said inlet to said outlet, said inlet having an inlet area, and said outlet having an outlet area, said inlet area being greater than said outlet area, and at least one portion being concave or convex in the longitudinal direction between said inlet and said outlet, said funnel wall subtending a volume, said volume being defined by the inequality: volume≠π/3×h×[inlet radius^2+outlet radius^2+(inlet radius×outlet radius)], wherein h is the axial distance between the inlet and outlet taken parallel to the longitudinal axis, the inlet radius is greater than the outlet radius, and H is the known constant of approximately 3.14, and further comprising at least one flow diverter disposed on said funnel wall, said flow diverter imparting a spiral flow component to fluid flowing from said inlet to said outlet, said flow diverter comprising at least one groove in said funnel wall.

3. A helix cup according to claim 1 wherein said funnel wall is generally concave between said inlet and said outlet.

4. A helix cup according to claim 3 wherein said funnel wall forms an inlet angle with respect to the longitudinal axis at said inlet, and said funnel wall forms an outlet angle with respect to the longitudinal axis at said outlet, said inlet angle being greater than said outlet angle.

5. A helix cup according to claim 3 wherein said area of said funnel wall is at least 10% less than the area of a comparable area of a frustrum of a right circular cone having the same inlet radius, outlet radius and cone length.

6. A helix cup according to claim 5 wherein said area of said funnel wall is at least 20% less than the area of a comparable area of a frustrum of a right circular cone having the same inlet radius, outlet radius and cone length.

7. A helix cup according to claim 6 wherein said longitudinal axis has an axis length, said funnel wall having a first portion subtending said inlet angle and a second portion subtending said outlet angle, said first portion comprising from 60-85 percent of said axis length.

8. A helix cup according to claim 1 wherein said at least one flow diverter comprises a plurality of grooves in said funnel wall.

9. A helix cup according to claim 2 wherein said subtended volume is given by the inequality:

volume≤Π/3×*h*×[inlet radius^2+outlet radius^2+(inlet radius×outlet radius)].

10. A helix cup according to claim 9 wherein said subtended volume is at least 10% less than the volume of a comparable area of a frustrum of a right circular cone having the same inlet radius, outlet radius and cone length.

11. A helix cup according to claim 10 wherein said subtended volume is at least 20% less than the volume of a comparable area of a frustrum of a right circular cone having the same inlet radius, outlet radius and cone length.

12. A helix cup according to claim 10 further comprising a plurality of grooves in said funnel wall, said grooves imparting a spiral flow component to fluid flowing from said inlet to said outlet.

13. A helix cup according to claim 11 wherein said grooves are symmetrically disposed around said longitudinal axis and have a proximal end juxtaposed with said inlet and terminating at a distal end between said inlet and said outlet.

14. A helix cup according to claim 12 wherein each said groove monotonically tapers from a first width at said proximal end to a lesser width juxtaposed with said distal end.

15. A helix cup according to claim 13 wherein each said groove forms an angle between 5 degrees and 12 degrees between the distal end of said groove and a plane disposed perpendicular to said longitudinal axis.

16. A helix cup according to claim 14 wherein said plurality of grooves comprises four grooves, said grooves being equally circumferentially spaced apart.

17. A helix cup according to claim 2 wherein inlet has an inlet area and said outlet has an outlet area, at least one of said inlet and said outlet being nonround.

18. A helix cup according to claim 2 wherein inlet has an inlet area and said outlet has an outlet area, the ratio of said inlet area to said outlet area being at least 10:1.

19. A helix cup according to claim 18 further comprising a nozzle having a chamfer.

* * * * *